US005564777A

United States Patent [19]

Wild

[11] Patent Number: 5,564,777

[45] Date of Patent: Oct. 15, 1996

[54] FOLDABLE CHAIR HAVING INTEGRAL HINGES

[76] Inventor: Franklin J. Wild, 63432 Ridge Avenue, Lawrence, Mich. 49065

[21] Appl. No.: 486,601

[22] Filed: Jun. 7, 1995

[51] Int. Cl.[6] ..... A47C 4/08

[52] U.S. Cl. ..... 297/16.1; 297/37

[58] Field of Search ..... 297/16.1, 34, 54, 297/37, 36, 411.34

[56] References Cited

U.S. PATENT DOCUMENTS

| | | | |
|---|---|---|---|
| 857,914 | 6/1907 | Weber | 297/37 X |
| 1,281,763 | 10/1918 | Carré | 297/37 X |
| 1,342,715 | 6/1920 | Howe | 297/37 X |
| 1,419,947 | 6/1922 | Schouten | 297/37 X |
| 1,978,870 | 10/1934 | Thuren | 297/37 |

*Primary Examiner*—Peter M. Cuomo
*Assistant Examiner*—Rodney B. White
*Attorney, Agent, or Firm*—Gordon W. Hueschen

[57] ABSTRACT

A foldable chair entirely in the form of a single piece of plastic, comprising a seat, a back hingedly connected to the seat, arm rests hingedly connected to the side edges of the seat, a rear leg assembly hingedly connected to the rear edge of the seat, and a front leg assembly hingedly connected to the front edge of the seat. The entire structure including the hinges is integral and comprised of the same piece of plastic material. The chair is erected by folding the front and rear leg assemblies in place, folding the arm rests over the seat, thereby retaining the leg assemblies in place, and affixing the arm rests to the back of the chair, thereby resulting in a strong rigid chair.

15 Claims, 5 Drawing Sheets

FOLDABLE CHAIR HAVING INTEGRAL HINGES

BACKGROUND OF THE INVENTION

1. Field of Invention

The present invention relates to chairs which may be folded for carrying, and more particularly relates to a folding chair which has integral hinges connecting the various parts, and which chair may be molded and/or stamped from a plastic material.

Folding or foldable chairs are known in the art and generally comprise a back, a seat, armrests, and rear and front legs. The parts which are foldable are generally joined to the other parts by means of hinges or other means which are generally applied from external parts to form hinges. Such chair structures are generally expensive to fabricate since they require separate assembly steps to apply hinge means to hinge the various parts together where the parts are to be folded to prepare the chair for being carried. Additionally, such chairs must be fabricated from rather expensive parts and expensive materials.

OBJECTS OF THE INVENTION

It is an object of the present invention to provide a folding chair which may be readily manufactured.

It is a further object of the invention to provide a foldable chair which may be entirely fabricated from a material such as plastic.

It is an additional object of the present invention to provide a chair of the type described in which the seat, the arm rests, the back, and the front and rear legs are articulated together by means of hinges which are integral with the remainder of the material which forms the various parts of the chair.

It is an additional object of the present invention to provide a chair of the type described which may be readily folded into a small package having a handle suitable for being carried about like a briefcase.

It is still a further object of the present invention to provide a chair of the type described which is strong and rigid to support the weight of an individual.

The foregoing and other objects, advantages, and characterizing features of the invention will become apparent from the following description of certain illustrative embodiments thereof considered together with the accompanying drawings, wherein like reference numerals signify like elements throughout the various figures.

SUMMARY OF THE INVENTION

According to the present invention, a folding chair is formed from a plastic material, with the various parts of the chair such as the seat, the arm rests, the back, and the front and rear legs articulated together by means of hinges which are integral with the remainder of the material which forms the various parts of the chair. Optionally the chair is formed by a single injection mold comprising all necessary components including the hinges attached in one continuous piece of plastic. The manufacture of the folding chair may include, in addition to the single injection mold, a campressing procedure whereby certain elements of the structure are finished.

What we believe to be our invention, then comprises the following, inter alia, or in combination:

A foldable chair formed of a single piece of plastic material, comprising a seat, a back connected to said seat by an integral hinge, a rear leg assembly comprising a right leg and a left leg, each leg being hingedly connected to said seat by means of an integral hinge, a front leg assembly comprising a right front leg and a left front leg connected together, said front leg assembly being hingedly connected to the front edge of said seat, a right arm rest hingedly connected to the right edge of said seat by an integral hinge, a left arm rest hingedly connected to the left edge of said seat by an integral hinge, means for detachably affixing said right and left arm rests to said back to establish said chair in the erect condition, and flange means affixed to said rear leg assembly adapted to be interposed between said arm rests and said seat when in the erect condition, and flange means affixed to said front leg assembly adapted to be interposed between said arm rests and said seat, whereby when said flange means are properly inserted and said arm rests are affixed to said back, said chair is maintained in the erect condition, and whereby, when arm rests are disengaged from said back, said chair may be placed in the folded condition, such a foldable chair formed of polyurethane, such a foldable chair formed of polyvinyl chloride, and such a foldable chair formed of polyethylene.

DESCRIPTION OF THE DRAWINGS

In the drawings:

Referring to FIGS. 1 and 2, the chair 10 according to the invention is shown in fully erected condition. The chair 10 comprises a seat 12, a back 14, a right arm rest 16, and a left arm rest 18. The chair also comprises a rear leg assembly 20 including rear legs 40 and 41, and a front leg assembly 22 including front legs 44 and 45. The back 14 is formed into arm rest-engaging extensions 24 and 26 having lockpins 28 and 30 mounted therein for engaging the arm rests 16 and 18. The right arm rest 16 is connected to the seat 12 by means of an integral hinge 32 and the left arm rest is connected to the seat 12 by means of an integral hinge 34. A central flange 36 extends rearwardly from the seat and is hingedly connected to the back 14 by means of an integral hinge 38. The rear legs 40 and 41 are hingedly connected to the seat 12 by means of separate integral hinges 42. The front leg assembly 22 has a panel connecting both front legs 44 and 45, which are hingedly connected to the seat 12 by means of a single integral hinge 46. The perimeter of the seat 12 is in the form of a frame formed by terminal flanges including a front flange frame 50, a rear flange frame 52, a right lateral flange frame 54, and a left lateral flange frame 56. The seat 12 is also provided with a depending contour 58 for comfortable seating. The right arm rest 16 is provided with a terminal flange 60 having a keyhole slot 62 provided therein. The left arm rest 18 is provided with a terminal flange 64 having a keyhole slot 66 provided therein. The keyhole slot 62 is adapted to engage the right lockpin 28, and the left keyhole slot 66 is adapted to engage the left lockpin 30, thereby securing the two arm rests to the back of the chair. The lower portion of the right arm rest 16 is provided with a lateral panel 68 and a descending flange 70. The left arm rest 18 is provided with a lateral panel 72 and a descending flange 74.

Figure 2:
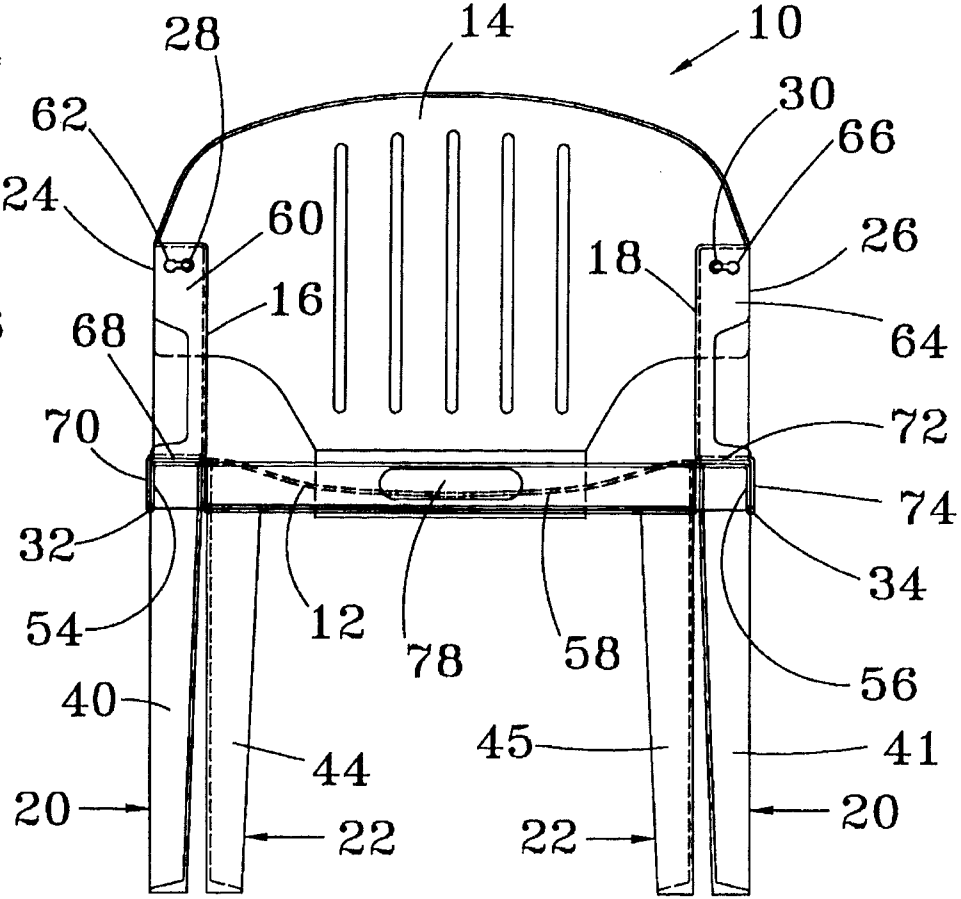
FIG. 2 is a front elevational view of the chair shown in FIG. 1, portions of the chair shown in cross-section.

The rear leg assembly is provided with rear leg flanges 84. In the fully erect condition the flanges 84 are clamped between the lateral panels 68 and 72 and a rear recessed portions 88 of the seat 12. The front leg assembly 22 is provided with a flange 98, which, in the fully erect condition of the chair is clamped between the lateral panels 68 and 72 of the arm rests 16 and 18 and front recessed portions 100 of the seat 12. In the erect condition the right arm rest 16 and left arm rest 18 are held tightly against the back by the lockpins 28 and 30 and the keyhole slots 62 and 66, the lower portions of the right arm rest and left arm rest retaining the rear leg flanges 84 and front assembly flange 98 wedged against the seat, with the result that the chair is held in a completely rigid condition.

Figure 1:
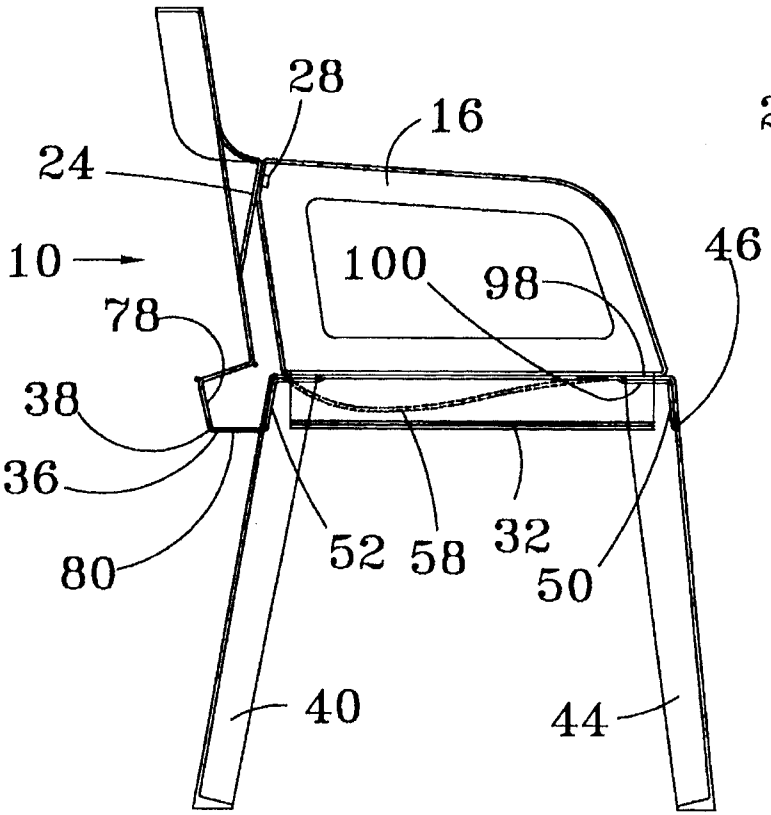
FIG. 1 is a side elevational view of the invention in assembled form, portions shown in cross-section.

In order to place the chair 10 shown in FIGS. 1 and 2 in folded condition, the keyhole slots 62 and 66 are disengaged from the lockpins 28 and 30, respectively. The arm rests 16 and 18 are then folded down, thereby releasing the back 14 which is also folded down. Since the arm rests no longer engage the flanges of the leg assemblies, the leg assemblies are also free to be folded down.

Figure 4:
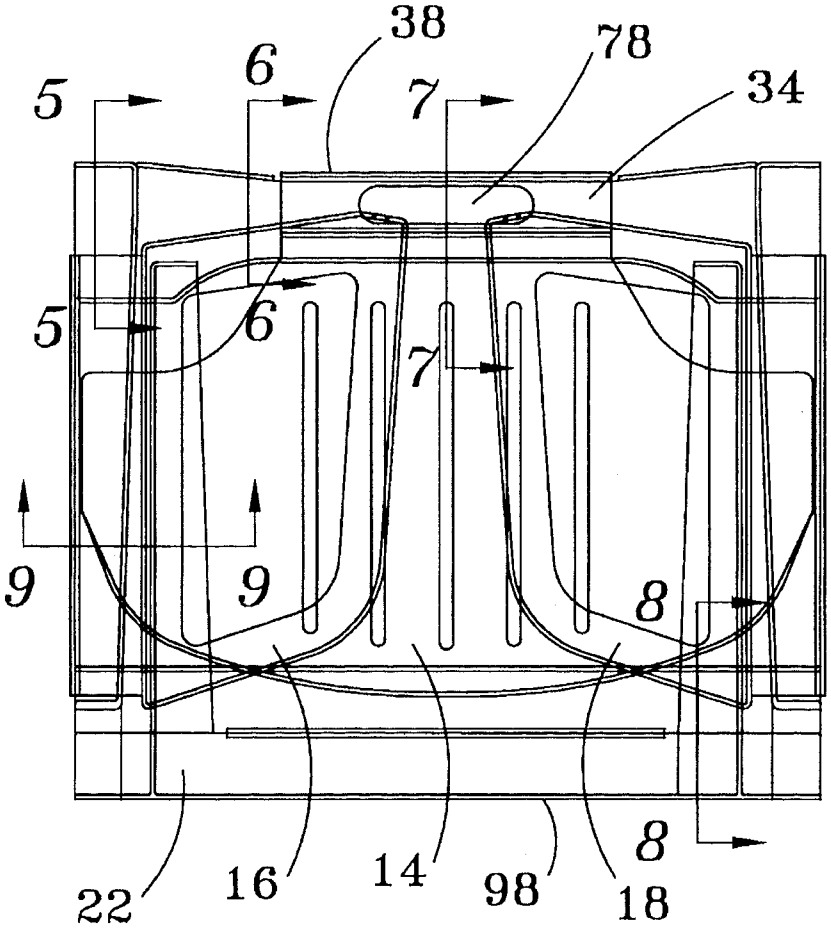
FIG. 4 is a top view of the chair shown in FIG. 3 in completely folded condition.
Figure 3:
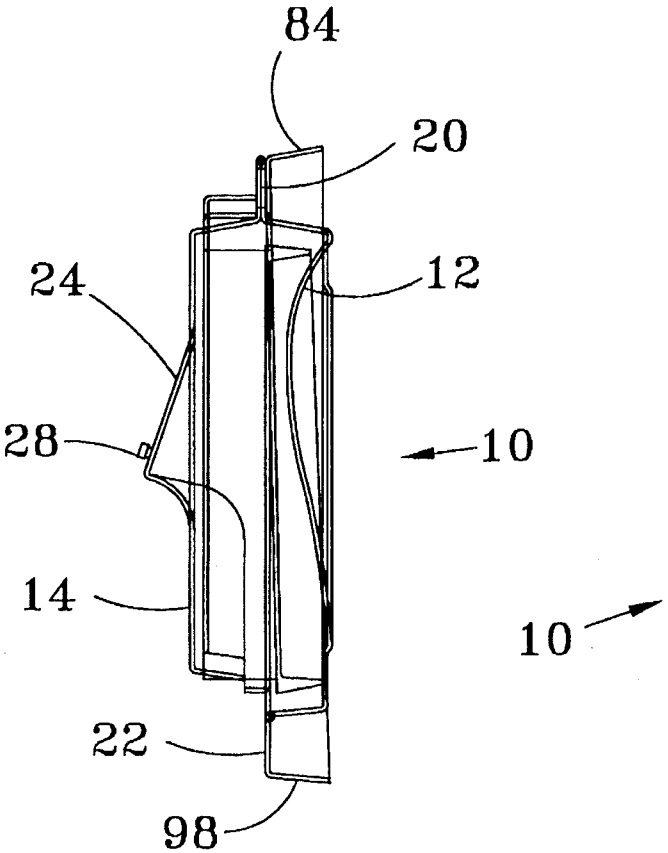
FIG. 3 is a left side elevational view of the chair shown in completely folded condition.

Referring to FIGS. 3 and 4, the chair is shown in fully folded condition. In this condition a hand may be inserted into the elongated apertures 78 and 80 forming the handle.

Figure 5:
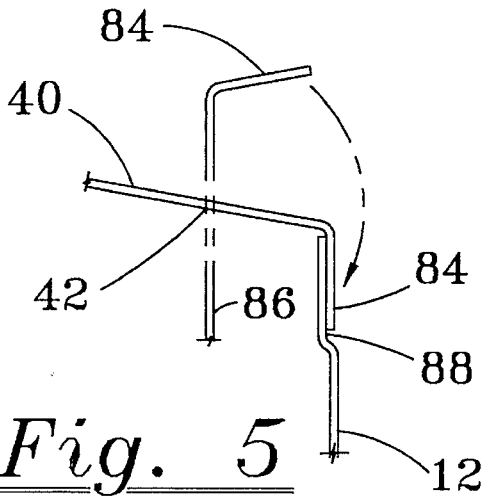
FIG. 5 is a fragmentary cross-sectional view taken at the line 5—5 of FIG. 4.

Referring to FIG. 5, a fragment of a rear right leg 40 is shown both in folded condition and in erected condition.

Figure 6:
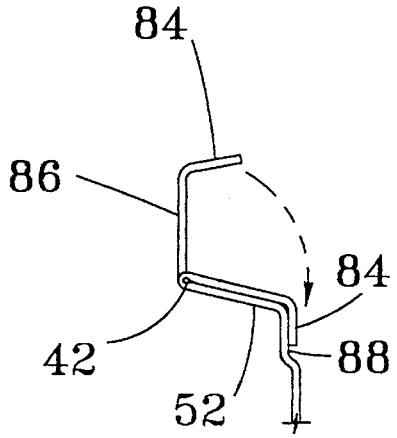
FIG. 6 is a fragmentary cross-sectional view taken at the line 6—6 of FIG. 4.

Referring to FIG. 6, another fragmentary section of the rear right leg assembly 20 is shown both in the folded and in erect condition. In this view the rear seat flange 52 is also shown.

Figure 7:
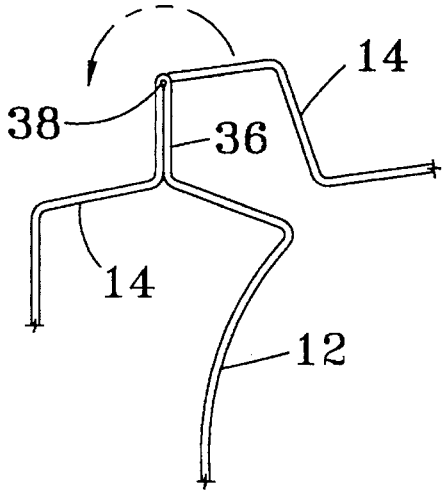
FIG. 7 is a fragmentary cross-sectional view taken at the line 7—7 of FIG. 4.

Referring to FIG. 7, the back 14 and seat 12 are shown in fragmentary view both in the folded and erect condition.

Figure 8:
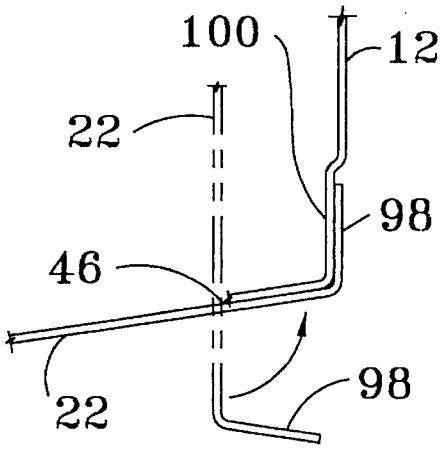
FIG. 8 is a fragmentary cross sectional view taken at the line 8—8 of FIG. 4.

Referring to FIG. 8, the left front leg is shown in fragmentary view both in the folded and erect condition. Shown therein is the seat 12, the front leg assembly flange 98, and the front recessed portion 100 of the seat 12.

Figure 9:
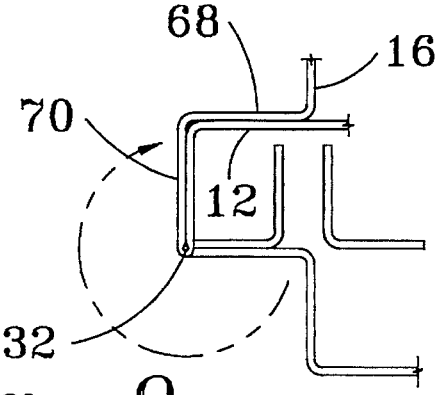
FIG. 9 is a fragmentary cross-sectional view taken at the line 9—9 of FIG. 4.

Referring to FIG. 9, the right arm rest 16 comprising the lateral panel 68, the descending flange 70, and the right arm rest integral hinge 32 are shown. The right arm rest 16 is shown in both the folded and erect condition. Also shown are the right rear leg 40 of the rear leg assembly 20, and the right front leg 44 of the front leg assembly 22 in folded condition.

Figure 10:
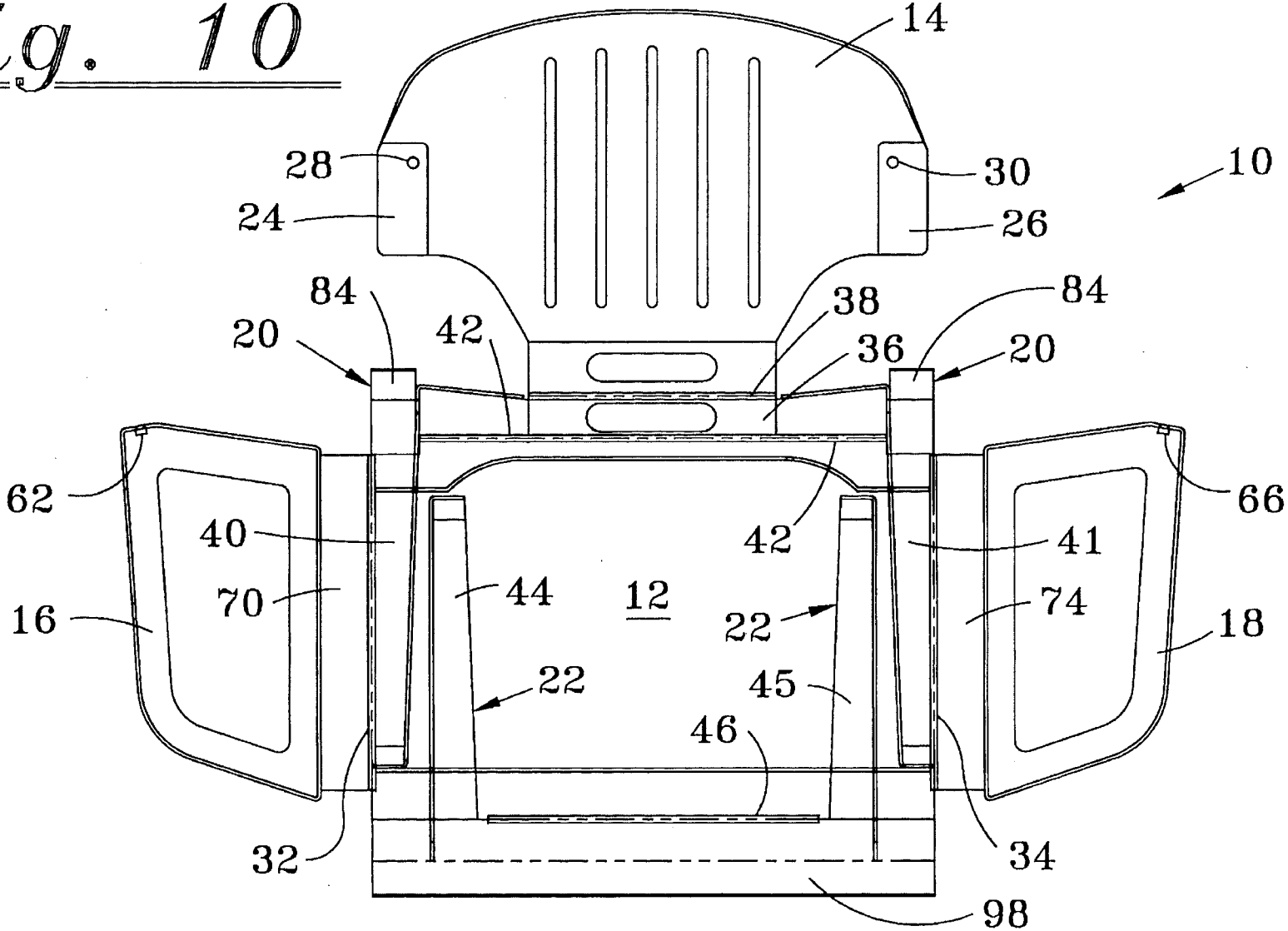
FIG. 10 is a plan view of chair shown in FIGS. 1–9 showing the chair in unassembled condition.

Referring to FIG. 10, the chair 10 of the invention is shown with the back 14 and arm rests 16 and 18 in unfolded flat condition, and with the rear leg assembly 20 and the front leg assembly 22 partially folded under the seat 12.

Figure 11:
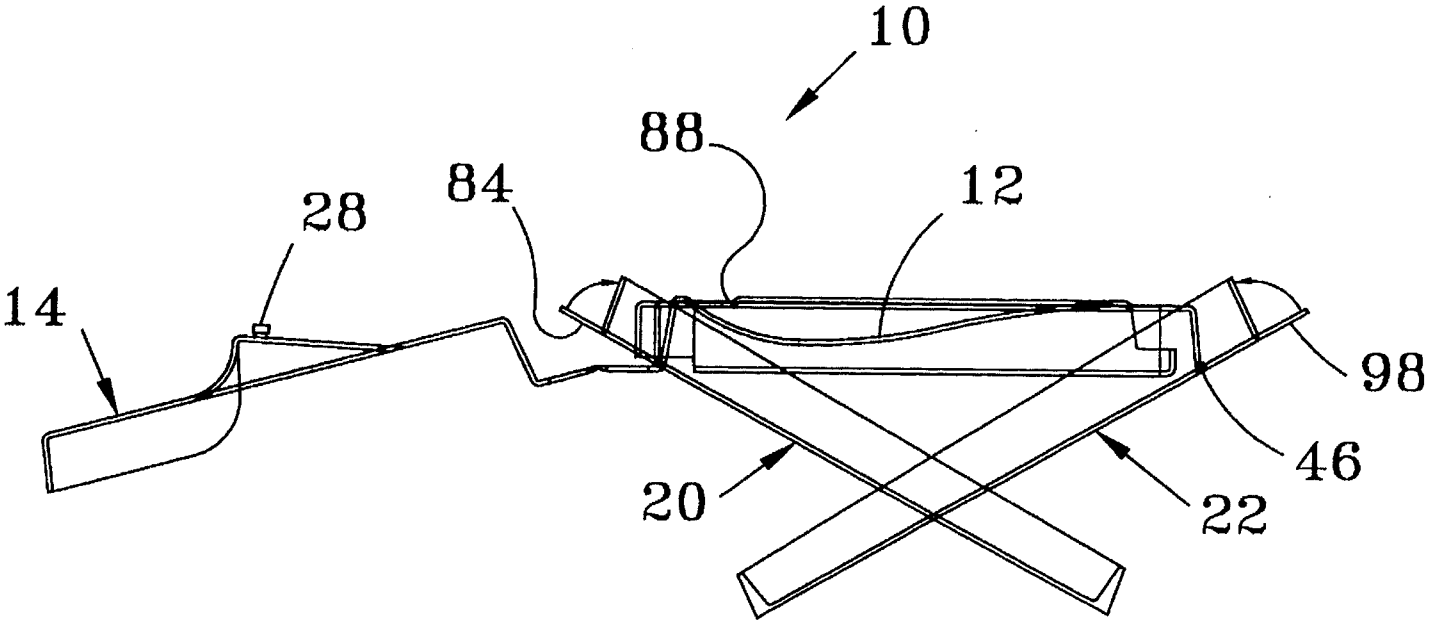
FIG. 11 is a side elevational view of the chair in the condition shown in FIG. 10.

Referring to FIG. 11, the chair 10 is shown in the same condition as that of FIG. 10, but in side elevational view. Additionally shown is an expediency in the fabrication of the chair, wherein as the chair is formed, the rear leg flanges 84 and the front leg assembly flange 98 may first be formed in the condition in which they extend longitudinally from the respective leg assemblies. The flanges 84 and 98 may then be bent over by suitable means such as heat forming to place them in the condition in which they are perpendicular to the longitudinal direction of the leg assemblies.

The chair of the present invention may be formed of any suitable plastic material such as polyurethane, polyvinylchloride, polyethylene, or any other suitable material. The material utilized should be sufficiently rigid so that the legs and structure of the chair will support the weight of a human being without collapsing. Additionally the material must be such that when properly formed or treated, the integral hinges formed from the same plastic material will bend sufficiently to permit the various structures to be folded into the proper condition. If desired, the material at the site of the hinges may be made somewhat thinner to enable them to bend more readily. Alternatively, they may be treated with a plasticizer or otherwise to make them more flexible.

The chair of the present invention has the advantage that it is readily formed from a single piece of plastic material as by injection molding or forming by other means known in the art. The chair is relatively inexpensive to fabricate and may be done so with low labor costs. It may be readily placed in the erect condition for use as a chair, and may be readily folded into a handy compact package which may be carried like a briefcase by means of the integral handle formed by providing elongated apertures through which the hand may be placed.

It is to be understood that the present invention is not to be limited to the exact details of operation, or to the exact compounds, compositions, methods, procedures, or embodiments shown and described, as various modifications and equivalents will be apparent to one skilled in the art, wherefore the present invention is to be limited only by the full scope which can be legally accorded to the appended claims.

It is also be to understood that, in the appended claims, wherein reference numerals are applied to the various structures, this is done primarily for convenience and to facilitate an understanding of the structure of the invention as defined in the claims and is not to be considered as in any way limiting the scope of the claimed invention.

I claim:

1. A foldable chair (10) having an erect condition and a folded condition formed of a single piece of plastic material, comprising a seat (12) having a right edge, a left edge, and a front edge, a back (14) connected to said seat (12) by an integral hinge (38), a rear leg assembly (20) comprising a right leg (40) and a left leg (41), each leg being hingedly connected to said seat (12) by means of an integral hinge (42), a front leg assembly (22) comprising a right front leg (44) and a left front leg (45) connected together, said front leg assembly (22) being hingedly connected to the front edge of said seat (12), a right arm rest (16) hingedly connected to the right edge of said seat (12) by an integral hinge (32), a left arm rest (18) hingedly connected to the left edge of said seat (12) by an integral hinge (34), means for detachably affixing said right and left arm rests to said back (14) to establish said chair (10) in the erect condition, and flange means (84) affixed to said rear leg assembly (20) adapted to be interposed between said arm rests (16) (18) and said seat (12) when in the erect condition, and flange means (98) affixed to said front leg assembly (22) adapted to be interposed between said arm rests (16) (18) and said seat (12) when in the erect condition, whereby, when said flange means (84) (98) are properly inserted between said arm rests and said seat, and said arm rests (16) (18) are affixed to said back (14), said chair (10) is maintained in the erect condition, and whereby, when said arm rests (16) (18) are disengaged from said back (14), said chair (10) may be placed in the folded condition.

2. A foldable chair according to claim 1, formed of polyurethane.

3. A foldable chair according to claim 1, formed of polyvinyl chloride.

4. A foldable chair according to claim 1, formed of polyethylene.

5. A foldable chair (10) according to claim 1, wherein said back (14) has an upper right side and an upper left side and wherein said means for detachably affixing said right and left arm rests (16) (18) to said back (14) comprises a pair of lockpins (28) (30), one affixed to the upper right side of said back (14) and the other affixed to the upper left side of said back (14), and a pair of keyhole slots (62) (66), one provided in said right arm rest (16) and one provided in said left arm rest (18), whereby said lockpins (28) (30) can engage said keyhole slots (62) (66) to secure said arm rests (16) (18) to said back (14).

6. A foldable chair (10) according to claim 1, wherein said back (14) has an upper right side and an upper left side and wherein said means for detachably affixing said right and left arm rests (16) (18) to said back (14) comprises a pair of lockpins (28) (30), one affixed to each of said right and left arm rests (16) (18), and a pair of keyhole slots (62) (66) provided, one at the upper right side of said back (14) and the other at the upper left side of said back (14), whereby said lockpins (28) (30) can be engaged by said keyhole slots (62) (66) to affix said arm rests (16) (18) to said back (14).

7. A foldable chair (10) according to claim 1, wherein said seat (12) has an upper surface and wherein the upper surface of said seat (12) is provided with a plurality of recesses (88 and 96) to receive the flange means (84) affixed to said rear leg assembly (20) and the flange means (98) affixed to said front leg assembly (22).

8. A foldable chair (10) according to claim 1, wherein said seat (12) has a rear edge and wherein said back (14) has a lower edge and wherein a central flange (36) extends from the rear edge of said seat (12) and wherein the lower edge of said back (14) is connected to said central flange (36) by an integral hinge (38).

9. A foldable chair (10) according to claim 8, wherein said back (14) has a lower portion and wherein an elongated aperture (78) is provided in the lower portion of said back (14) and an elongated aperture (80) is provided in said central flange (36), whereby in folded condition said elongated apertures (78) (80) are juxtaposed to serve as a handle for carrying said foldable chair (10) in the folded condition.

10. A foldable chair (10) according to claim 1, wherein said seat (12) is provided with a contour (58) so shaped as to approximate a seat of a person seated thereon.

11. A foldable chair (10) according to claim 1, wherein said arm rests (16) (18) are provided with panels (68) (72) adapted to engage and clamp the flange means (84) (98) of said front and rear leg assemblies (20) (22) against said seat (12).

12. A foldable chair (10) according to claim 1, wherein said back (14) is provided with a right arm rest engaging area (24) and a left arm rest engaging area (26) and said right and left arm rests are provided with terminal flanges (60) (64) adapted to engage the arm rest engaging areas of said back (14) and to become locked thereto.

13. A foldable chair (10) according to claim 1, wherein said front and rear legs have a V-shaped cross-section adapted to provide increased rigidity and strength to said legs.

14. A foldable chair (10) according to claim 1, wherein said seat (12) is provided with front (50), rear (52), right (54), and left (56) depending flanges to provide increased rigidity and strength to said seat (12).

15. A foldable chair (10) according to claim 1, wherein handle means is provided thereon for carrying said foldable chair (10) in the folded condition.

* * * * *